United States Patent [19]

Klein

[11] Patent Number: 4,733,896

[45] Date of Patent: Mar. 29, 1988

[54] LIFT CONTAINER AND METHOD FOR USING SAME

[75] Inventor: Richard A. Klein, Pittsburgh, Pa.

[73] Assignee: Harsco Corporation, Camp Hill, Pa.

[21] Appl. No.: 838,381

[22] Filed: Mar. 11, 1986

[51] Int. Cl.[4] ..... B65D 19/06; B66B 9/20; E04G 21/16

[52] U.S. Cl. ..... 294/67.1; 29/428; 108/56.1; 182/128; 182/142; 220/4 F; 294/67.4; 294/68.1; 414/10

[58] Field of Search ..... 294/67.1, 67.4–67.5, 294/68.1–68.21, 68.26, 68.3; 29/157.4, 428; 108/55.1, 56.1, 56.3; 182/128, 142; 206/386, 600; 220/1.5, 4 R, 4 C, 4 F; 414/608, 10, 12, 786; 52/741, 749

[56] References Cited

U.S. PATENT DOCUMENTS

| | | | |
|---|---|---|---|
| 1,524,444 | 1/1925 | Malia . | |
| 1,774,643 | 9/1930 | Fullerton | 294/67.1 |
| 1,858,701 | 5/1932 | Boettcher . | |
| 2,359,406 | 10/1944 | Crosser | 108/55.1 |
| 2,871,619 | 2/1959 | Walters . | |
| 2,920,781 | 1/1960 | Butcher et al. | 220/1.5 X |
| 3,080,941 | 3/1963 | Fuller | 182/128 X |
| 3,420,332 | 1/1969 | Textor | 182/128 |
| 3,591,033 | 7/1971 | Partridge | 294/68.1 X |
| 3,696,960 | 10/1972 | Smirle . | |
| 3,827,744 | 8/1974 | Ferdelman et al. . | |
| 3,830,380 | 8/1974 | Spencer . | |
| 3,866,382 | 2/1975 | Van Tassel . | |
| 3,927,502 | 12/1975 | Smith . | |
| 3,966,285 | 6/1976 | Porch et al. | 220/4 F X |
| 4,048,754 | 9/1977 | Laux . | |
| 4,221,537 | 9/1980 | Mamula et al. . | |
| 4,232,636 | 11/1980 | Prohazka . | |
| 4,295,431 | 10/1981 | Stavlo | 294/68.21 X |
| 4,303,363 | 12/1981 | Cervin . | |
| 4,422,558 | 12/1983 | Mittelmann et al. | 220/4 F X |
| 4,474,497 | 10/1984 | Sullivan . | |
| 4,535,727 | 8/1985 | Ziegler . | |

FOREIGN PATENT DOCUMENTS

| | | | |
|---|---|---|---|
| 115138 | 5/1942 | Australia | 220/4 F |
| 2157976 | 11/1971 | Fed. Rep. of Germany . | |
| 1351520 | 12/1963 | France | 294/67.41 |
| 2411796 | 8/1979 | France | 414/608 |
| 1168661 | 8/1966 | United Kingdom . | |
| 2046342 | 4/1979 | United Kingdom . | |

*Primary Examiner*—Johnny D. Cherry
*Attorney, Agent, or Firm*—A. Thomas S. Safford

[57] ABSTRACT

A unique lift container for use in erecting scaffolding within power boilers and similar large enclosures having small access manholes, preferably being made from modularized forming equipment so as to be readily disassembled into constituent parts dimensioned to fit through the small access openings of such boilers.

16 Claims, 11 Drawing Figures

FIG. 2
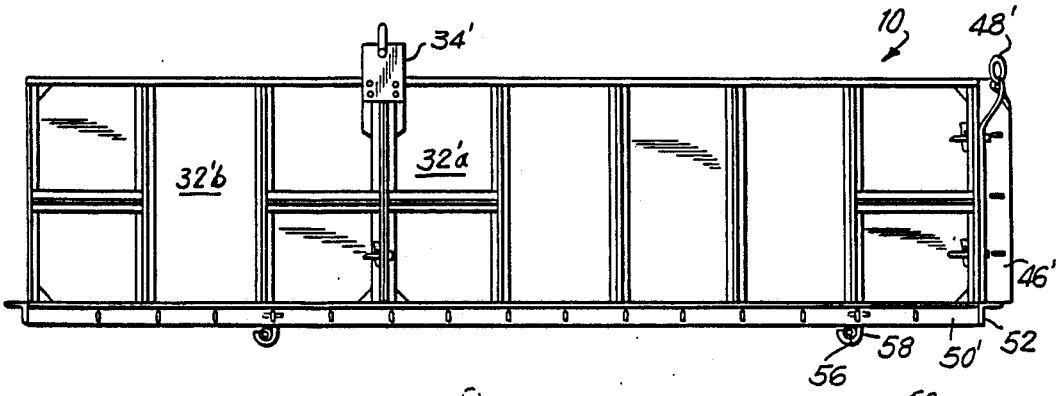
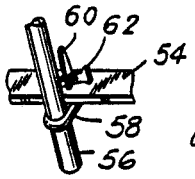
FIG. 2A
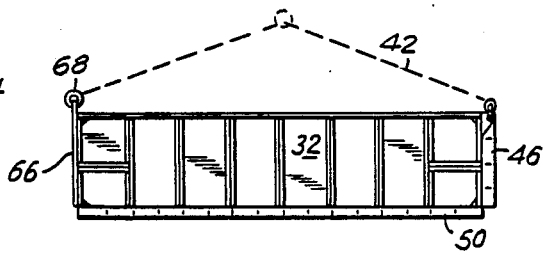
FIG. 2C
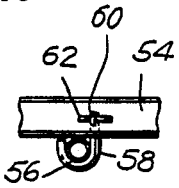
FIG. 2B
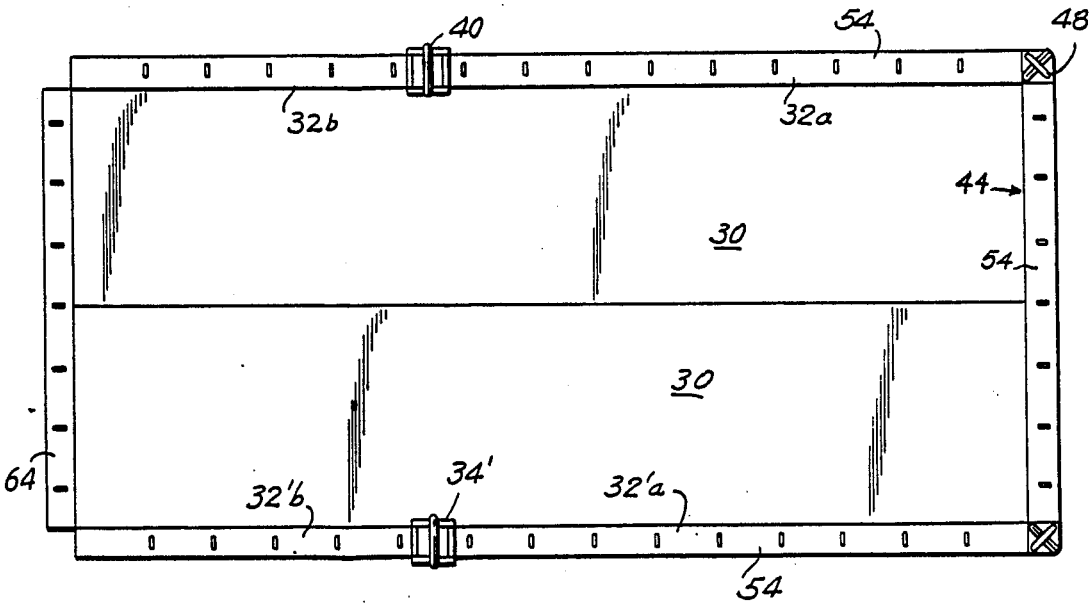
FIG. 3

LIFT CONTAINER AND METHOD FOR USING SAME

FIELD OF THE INVENTION

The present invention relates to method and apparatus useful particularly with temporary installations for efficient hoisting of scaffolding equipment and/or other material within large enclosures having small access openings.

BACKGROUND OF THE INVENTION

It is often necessary to erect scaffolding for repair, construction, inspection, cleaning, or other maintenance within large cavernous structures having very small access holes thereto. This type of situation is very commonly encountered in the power, paper, and other industries where fossil fueled steam boilers are commonly utilized to produce steam for generating electrical power, for chemical processing, or the like. It is often necessary to shut down such boilers for cleaning and general maintenance, as well as for emergency repairs. Since these structures involve large capital investment and result in substantial financial loss when not in operation, it is important that the time for servicing such boilers be minimized. Lost income can be as high as several hundred thousand dollars per day of shut down. Merely saving one day in scaffolding erection time can more than offset the total cost of the scaffolding. Consequently, anything which can increase the speed of erecting temporary scaffolding within such structures by more efficiently handling material as is necessary within such structures has significant commercial value.

This has been a recognized need in this industry for at least ten years, and probably considerably longer.

A limiting factor in such boilers or similar equipment is the very small size of the access openings to the interior. For example, the inner walls of modern boiler furnaces contain an array of steam generating tubes protectively lining all of the walls. The interruption of this array is minimized and is typically limited to a few manholes which may typically range in size from 18" to 30" in diameter (or along a side, if a square or rectangular opening).

Anything which is to be used in the interior of such boilers must pass through these access holes, and where appropriate should also be readily removable from the interior after the temporary use is completed, so that such equipment will not be subjected to the destructive high temperatures typical in the interior of the boiler during normal operation.

In earlier years, temporary custom-made wooden scaffolding would have been used in such boilers. At the present time, this would be prohibitively expensive because of the high cost and limited life of wood and because of the high labor costs due to labor-intensive requirements and the need for more highly paid semi-skilled workmen.

For a time, suspended scaffolding of the types shown in British Patent Nos. 822,327 (1955) and 1,123,841 (1964) were utilized. However, such suspended scaffolding limited the number of persons who could work in the boiler interior at any one time. This was not desirable for those installations where downtime could result in revenue losses of hundreds of thousands of dollars per day.

Somewhat more recently, by at least the 1970's, tube and coupler type erected scaffolding was adopted for such jobs for reasons of efficiency and safety. This also was time consuming, and required skilled laborers capable of following detailed planning and layout with careful measuring.

This was in turn replaced by modularized post-and-runner type scaffolding which can be erected faster and requires less skill. One method of using such equipment in slope-bottomed boilers was to weld brackets to hold the bottom posts in place on the sloping walls of the bottom of the boiler. See U.S. Pat. No. 4,496,026 showing another modified method of using this modularized post-and-runner equipment in boilers.

While the use of quick erecting modularized post-and-runner scaffolding equipment in such temporary installations has been a boon to the industry (see for example, applicant's assignee's U.S. Pat. No. 4,493,578, which is incorporated herein by reference), there has continued to be a serious drawback in using such equipment in boilers, etc. because of the bottleneck caused by the small access openings. The dismantled scaffolding equipment was not only required to be passed into the interior of the boiler through the small manholes, but was personally carried into place by individual workers or through a "human chain" method of internal material delivery. These cavernous structures can often be thirty feet by fifty feet and rise to several hundred feet and require an array of scaffolding filling the structures with platforms every six feet from the bottom level to the upper portions thereof. Thus, filling the entire structure with scaffolding by hand-to-hand methods, is very slow, very labor intensive, constitutes a safety problem, and therefore, is very costly.

The usual cranes, elevator hoists, and the like typically found at most construction sites are not available within such large structures because of the limitations of the small access openings. Several solutions to these problems have been proposed over the years without any proving feasible. These have included the attempted use of small buckets, canvas slings, endless conveyors, and the like. Yet the inefficient human chain method has persisted over such attempts in spite of its drawbacks.

OBJECTS OF THE INVENTION

Therefore, it is an object of the present invention to provide apparatus and methods of using the same which overcome the aforementioned disadvantages and more specifically, result in the efficient and rapid hoisting of material from one level to another within a large enclosed structure, and yet be readily and easily portable from one temporary installation to another through small access holes and also, advantageously, be optionally made from modularized equipment for easy replacement and also, for other use of the component parts during any extended time periods when not needed for internal boiler installations or the like.

SUMMARY OF THE INVENTION

In accordance with this invention, a box-like lift container having a size larger than conventional boiler access manholes is preferably made from modularized concrete forming equipment of a size which modularized parts readily pass through such access holes and are assembled by quick connect-disconnect equipment such as wedge bolts. The bottom, sides and ends of the container are made from panels, preferably concrete forming panels, of a width sufficiently small to fit through access holes and of a length sufficiently long to adequately handle the equipment to be hoisted. Typically, these would be 18" by 8' panels with at least one 3' by 18" end panel. Longitudinally shorter or longer panels can be utilized depending upon the intended use (preferably, from 4' to 12' in length, and preferably, from 1' to 3' in width). The floor of the container can be made from one or more such panels (preferably, two such panels joined along their longitudinal edges and braced, if necessary, by backing walers and/or end-edge-mounted angle irons, or other stiffening devices). The joinder between the side and bottom panels is fixed preferably by a corner bracket in the form of slotted angle irons, which slots are dimensioned and positioned to accommodate wedge bolt fasteners through corresponding slots in the backing frame of the concrete forming panels. The wedge bolts advantageously are used in pairs in the manner well known in the art. Between each end and side panel is a corner bracket preferably in the form of a similarly slotted column lift bracket, the upper end of which typically has a shackle for use as one of the pick points for a four point lifting bridle. Preferably, there is only one end panel, the other end remaining open to accommodate long pieces of equipment. The sides can similarly be made from one or more panels, joined end to end, if necessary (for example, joined by pairs of wedge bolts plus a gang lift bracket for each side to serve as the other two pick points).

In this specification and the accompanying drawings, applicant has shown and described several preferred embodiments of his invention and has suggested various alternatives and modifications thereto, but it is to be understood that these are not intended to be exhaustive and that many changes and modifications can be made within the scope of the invention. These suggestions herein are selected and included for purposes of illustration in order that others skilled in the art will more fully understand the invention and principles thereof and will thus be enabled to modify it and embody it in a variety of forms, each as may be best suited to the conditions of a particular use.

BRIEF DESCRIPTION OF THE DRAWINGS

FIG. 2 is a side elevation of the embodiment shown in FIG. 1;

FIG. 2A is an isometric view from below of a portion of the backing frame of the bottom panels of the device shown in FIG. 2 connected to a pipe waler by a J-shaped bracket and a pair of wedge bolts;

FIG. 2B is a side elevation of a pipe waler bracket assembly shown in FIG. 2A;

FIG. 2C is a side elevational view similar to FIG. 2, but of a single side panel (of the type used in FIG. 1A) modified for quicker assembly by having a column lift bracket of the type shown in FIG. 1B welded to one end of said panel, by having a corner bracket in the form of a slotted angle iron welded to the bottom edge of said panel, and by having a lift strap welded to the other end of said panel;

FIG. 3 is a plan view of the embodiment shown in FIG. 1;

DETAILED DESCRIPTION OF PREFERRED EMBODIMENTS

Figure 1A:
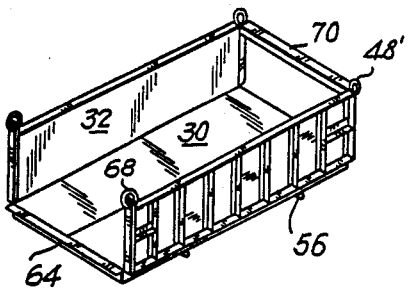
FIG. 1A is a similar view of a modified preferred embodiment (having a single end bracket and where each side is made from a single panel)
Figure 1:
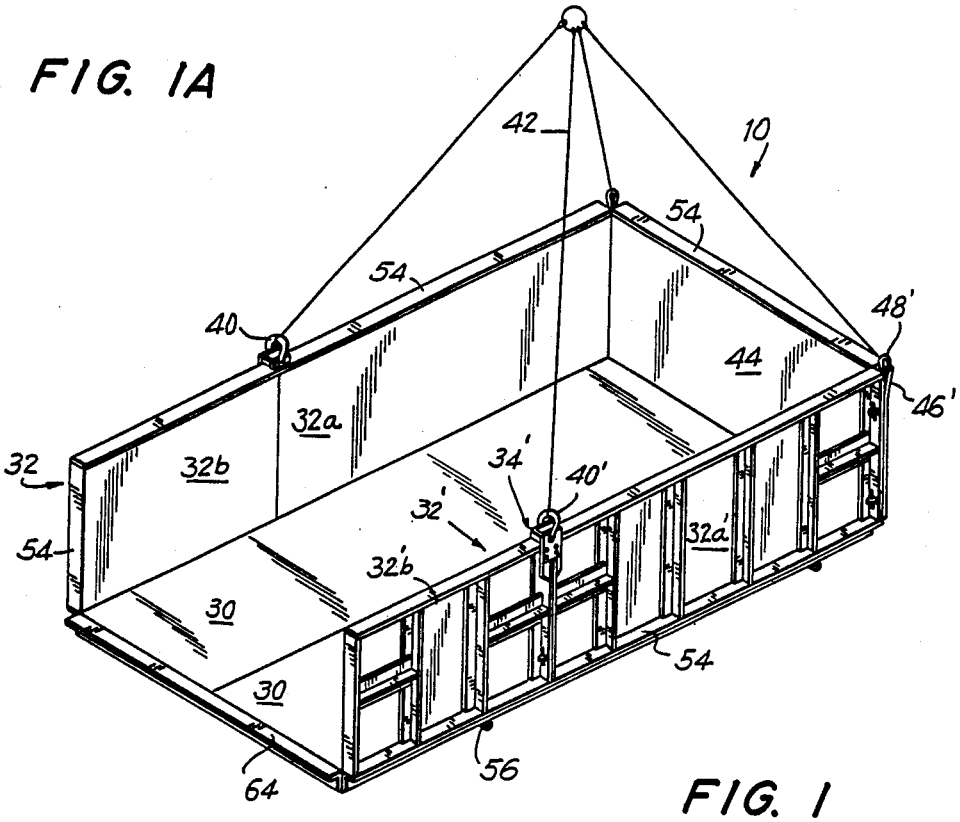
FIG. 1 is an isometric view of a preferred embodiment of the present invention showing a lift container made entirely from modularized concrete forming parts.
Figure 1B:
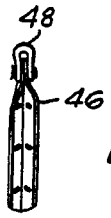
FIG. 1B is an isometric view of a column lift bracket.
Figure 4:
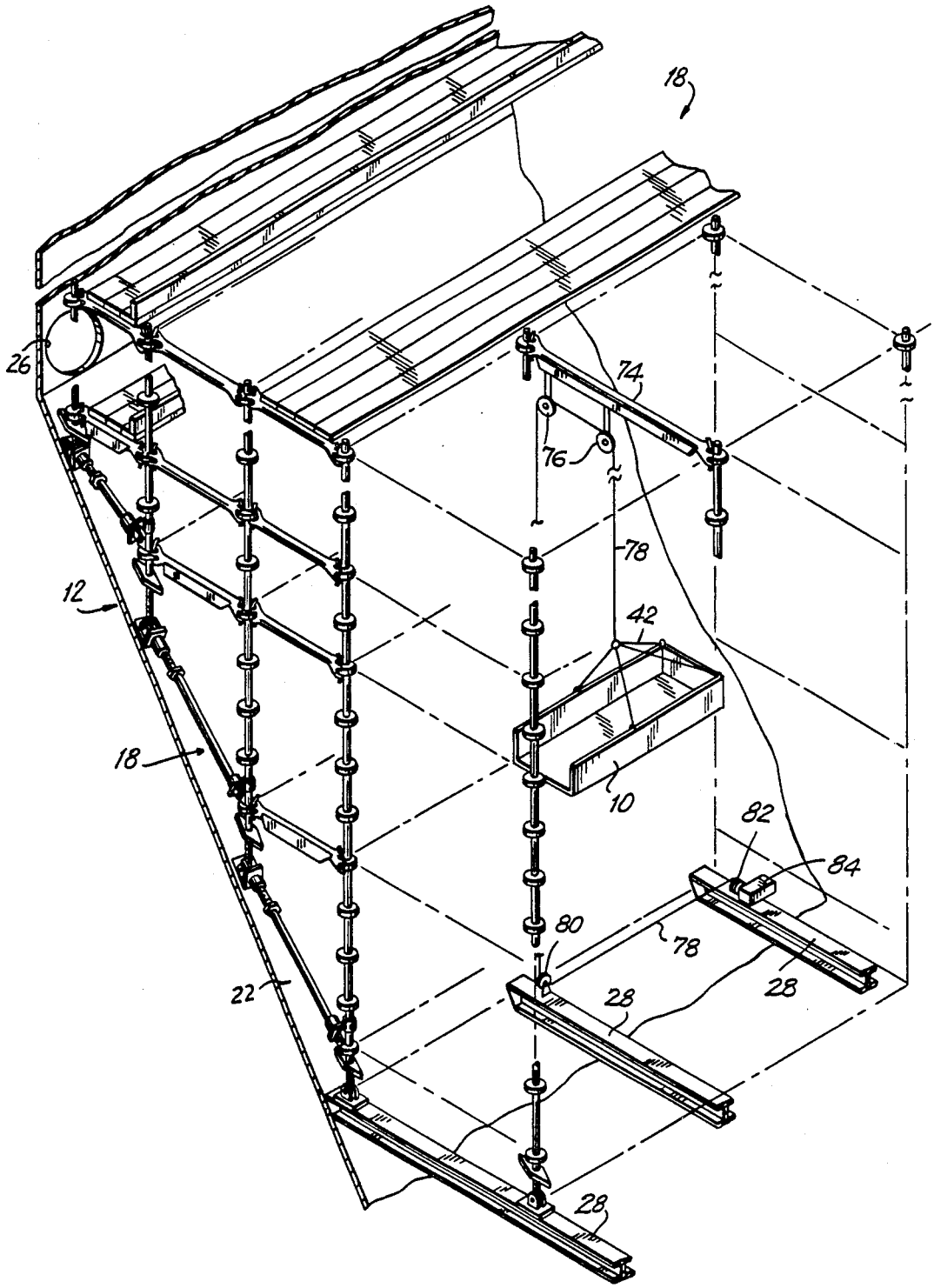
FIG. 4 is an isometric partially schematic view of post-and-runner type modularized scaffolding assembled within a boiler having sloping bottom walls and showing a single limited access hole in the vertical wall thereof, and particularly showing the embodiment shown in FIG. 1 incorporated into a hoist apparatus operative in an open bay of said erected scaffolding.
Figure 5:
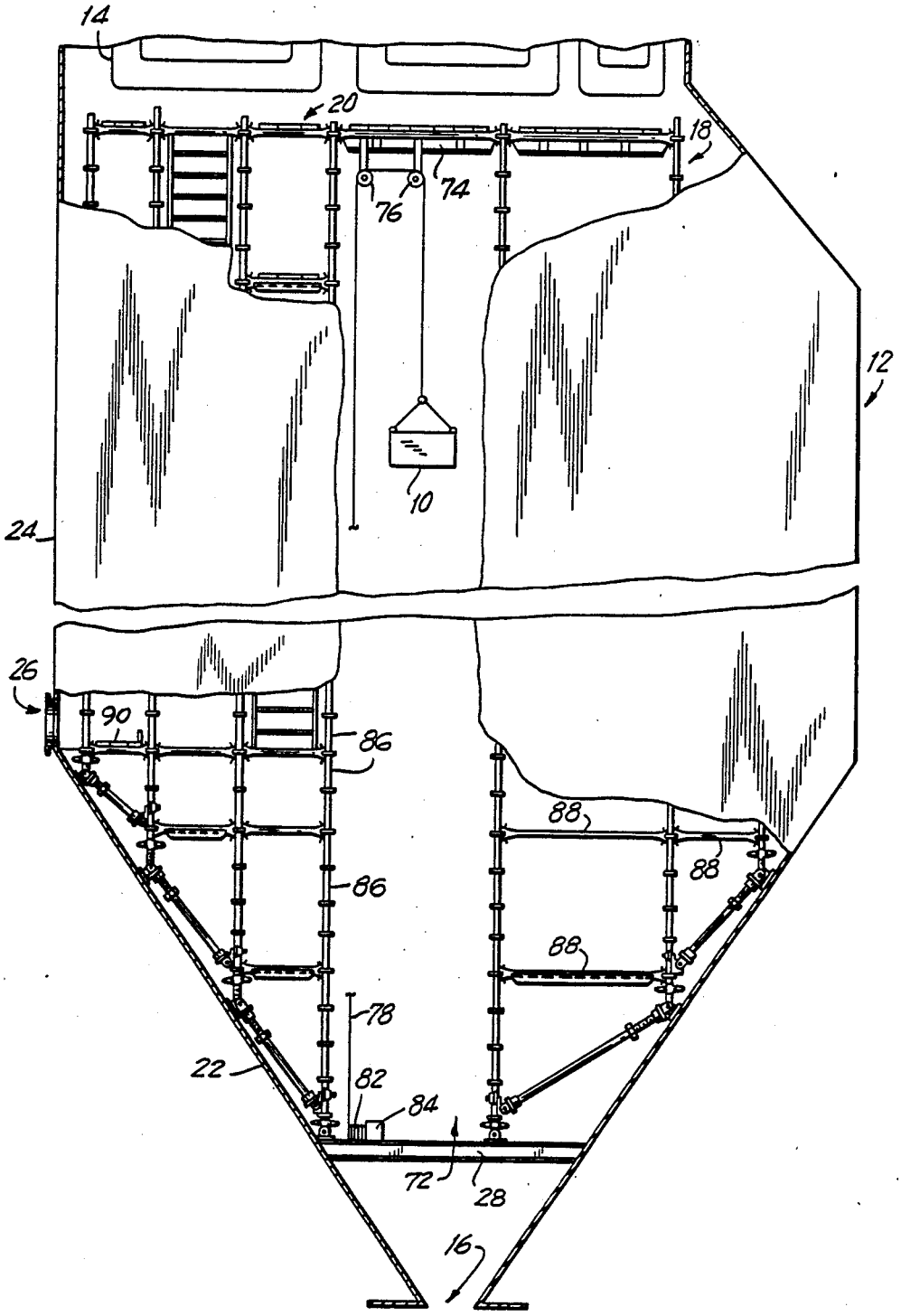
FIG. 5 is a partially sectioned side elevation of the boiler and scaffolding assembly shown in FIG. 4.

By referring to FIG. 5, one can appreciate the typical environment in which the box-like lift container 10 of FIG. 1 is typically employed. The boiler 12 for simplicity of illustration is not shown with any of its wall piping. However, the superheated piping 14 at the top of the boiler 12 is shown. In a typical example, the major width of the boiler 12 as illustrated is about 35' with a depth of as much as 50' or more, and with the superheating coils 14 being 100' above the bottom throat 16 of the boiler 12. It can be seen for purposes of illustration that the height of the boiler 12 in FIGS. 4 and 5 has been foreshortened (by omitting the central portion thereof). Fully erected scaffolding 18 is shown in the drawings with a stair unit 20 extending upwardly from the level at which the sloping bottom walls 22 of boiler 12 meet the vertical sidewalls 24. In this example, the access manhole 26 is positioned at the same level.

Twenty feet below this level in the illustrated embodiment are throat truss beams 28. These trusses 28 are preferably planked over soon after having been put in place during the initial erection of the scaffolding 18 prior to putting the remainder of the scaffolding 18 in place, so as to protect workmen cleaning out the ash pit (not shown) directly below the throat 16. As a result, the throat 16 is not accessible during most of the scaffolding erection procedure. Although this throat may run the depth of the boiler (e.g. on the order of 50'), its width is typically 2½' or less. This is in contrast to the 3' width of the container 10 in its preferred embodiment (were the throat even conveniently available at the time that the container is introduced into the boiler). Furthermore, the ash pit itself is typically limited in space because of the presence of a discharge auger and its associated machinery, and because typically there is only a 2'×4' access manhole to the ash pit.

A boiler 12 may often have only one single effectively accessible manhole 26. This is typically located at the level of the intersection of bottom walls 22 and vertical sidewalls 24. This may range from an oval opening with a major axis of 18" to as large as a square opening having 2½' on a side. In some boilers, such access holes are constructed purely for access. On others, they may be built for burner installation, which burners are removable to provide access through the resulting holes. Some boilers 12 may have some additional access holes 26(not shown) at widely spaced higher elevations.

In the preferred illustrated embodiment, the container 10 is 8' long, by 3' wide, by 1½' high. This clearly would not fit through the usual access hole. However, the maximum width of the modularized components from which it is rapidly assembled is advantageously 18".

Figure 1C:
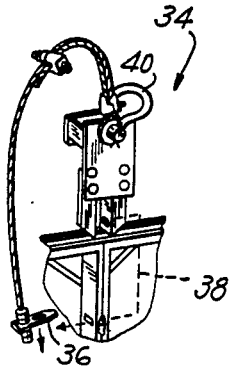
FIG. 1C is an isometric view similar to a detailed portion of FIG. 1 showing a gang lift bracket slightly above the corner portions of the end-abutted panels of one side of said container to which the gang lift bracket is adapted to be fastened.

As shown in FIG. 1, the major portion of the lift container is made from modularized concrete forming panels of the type sold by applicant's assignee under the trademark Mod-U-Form. These are steel panels with plywood facing. See applicant's assignee's U.S. Pat. No. 4,473,209 (which shows a similar panel backed by aluminum framing). These panels can be used to make up the floor, sides, and end(s) of the container. In the illustrated embodiment, the floor of the container is made from two 18 inch by 8 foot forming panels 30, to which are attached side panels 32 and 32'. In FIG. 1, each side panel is made up of a 5' long panel 32*a* and 32'*a*, and a 3' long panel 32*b* and 32'*b* . This permits the use of a standard gang lift bracket 34 at the joint between panels 32*a* and 32*b*, and of another gang lift bracket 34' at the joint of panels 32'*a* and 32'*b* . The bracket 34 is shown in FIG. 1C. When mounted in place, it is positioned over the top joint of the abutted side panels 32*a* and 32*b*, joining these two by a wedge bolt 36, secured by another wedge bolt (not shown) in the wedge bolt slots as indicated by the dotted arrow 38. The shackles 40 and 40' serve as two of the respective pick points for the lift bridle 42.

The end panel 44 is joined to the side panels 32*a* and 32'*a* by respective column lift brackets 46,46'. Each of these has a shackle 48,48' which latter serve as the remaining two respective pick points for the bridle 42.

The side panels 32,32' are joined to the respective floor panels 30 by slotted angle irons 50,50'. These are typically fastened together by pairs of wedge bolts longitudinally spaced in every other slot, approximately one foot apart.

The end panel 44 is similarly attached at right angles to the two floor panels 30 by slotted angle iron 52 using wedge bolts as fasteners.

As illustrated, the floor is made of two floor panels 30 joined in side-by-side planar relation by means of pairs of wedge bolts through slots in the marginal reinforcing backing frame 54 (which frame all of said panels have). To reinforce the planar alignment of the two panels 30, pipe walers 56, preferably, are used to span across such panels 30 at either end and are held in place by J hooks 58 (see FIGS. 2, 2A, and 2B). As shown particularly in FIG. 2A, the pipe waler 56 is fastened to the backing frame 54 of the panel 30 by means of a pair of wedge bolts 60 and 62 (which snugly secure the J hook 58 into place). Typically, the wedge bolt 60 is welded by its head to the upper end of the J bolt 58. However, the wedge bolts used to secure the angle brackets 50, 52, etc. to the various panels 30, 32, 44, etc. are typically identical loose hardware as are commonly known in the art.

As shown in FIG. 1, the open end of the container 10 preferably has further bracing 64 in the form of a slotted angle iron (similar to angle iron 52) affixed to the adjacent free ends of the pair of floor panels 30.

In FIG. 2C, an alternative preferred embodiment is shown wherein the side panel 32 is modified to have permanently welded thereto its respective column lift bracket 46 and its slotted angle iron 50. Furthermore, this side 32 is a single eight foot panel (rather than two separate panels 32*a* and 32*b* joined end-to-end). In place of the gang lift bracket 34, the side panel 32 of FIG. 2C has a liftstrap 66 welded to the end of the panel 32 opposite from the welded lift column bracket 46. At the upper end of liftstrap 66 is a shackle 68 which serves as the pick point at the open end of the container 10 for the lift bridle 42 (in place of the shackle 40 of the gang lift bracket 34).

In the embodiment illustrated in FIG. 1A, the end panel 44 has been replaced as the stiffening means by a bracket 70.

The use of the quick assembly-disassembly lift container 10 is shown in FIGS. 4 and 5. The component parts of the container 10 (the largest of which are typically the concrete forming panels), are passed through the manhole 26 into the interior of the boiler 12. Advantageously, prior to this, the bottom few levels of the scaffolding have been erected over the trusses 28 adjacent to the throat of the boiler 16. Typically, a central bay area 72 is left in the center of the array of scaffolding being erected, and is positioned opposite the manhole 26. This bay area might be typically 8 feet by 16 feet. The center of this bay is spanned by an eight foot cathead truss 74, having pulleys 76 spaced there-along to receive the liftline 78 which is secured to the lift bridle 42 of the container 10. The other end of the liftline 78 passes through a bottom pulley 80 to a wench 82 driven by a compact air motor 84.

It will be understood that as the erection of the scaffolding proceeds, the cathead 74 will be moved up and secured to each new top level until it is finally positioned at the top of the boiler as shown in FIG. 5. The nine foot posts and the three to eight foot runners typically used in the scaffolding 18 (of the type shown in U.S. Pat. No. 4,493,578) are passed into the boiler 12 through the manhole 26 onto the catwalk planking 90 and from there across to planking (not shown) adjacent the bay 72 for loading into the lift container 10.

The capacity of the container illustrated in these preferred embodiments is at least 2,000 pounds (even allowing for a significant safety factor). The container as shown in FIG. 1 weighs approximately 500 pounds and would obviously be very difficult to pass assembled into a small access hole (even if the hole were large enough).

Although surprising simple, no one prior to applicant had conceived of this design. Yet, it has been immediately applicable and has proven to reduce the scaffolding installation time in a typical boiler by as much as 25%, thereby resulting in significant money savings because of reduced boiler down time as well as as reduced cost because of lowered insurance premiums, fewer workman's compensation payments, and reduced total payroll.

Although in the preferred embodiment, the faces of the container are made from concrete forming panels assembled by use of wedge bolts, it will be readily understood that other panels with different quick disconnect means (i.e. not nuts and bolts) may be employed within the scope of the invention.

What is claimed is:

1. A method of hoisting materials with a poprtable box-like lift container within the interior of a large enclosed structure having one or more access holes, all of which holes that are effectively available for said container are dimensionally too small to pass said container, comprising the steps of obtaining components to use for assembling said container, said components having other uses for concrete forming and being sized to pass through at least one such effectively available access hole and including a plurality of rectangular panels for the floor and sides of said container, and quick connect-disconnect fastener means for joing said panels into an assembled box-like container, passing said components through at least one such effectively available access hole to the interior of said structure, assembling said container from said components within said structure, and using said container therein for hoisting said materials.

2. The method according to claim 1, wherein said quick connect-disconnect means include slotted wedge bolts.

3. A method of hoisting materials with a portable box-like lift container within the interior of a large enclosed structure having one or more access holes, all of which holes that are effectively available for said container are dimensionally too small to pass said container, comprising the steps of obtaining components used for assembling said container, said components being sized to pass through at least one such effectively available access hole and including a plurality of concrete forming panels for the floor and sides of said container, bracket means for joining said panels at right angles, and quick connect-disconnect means for securing said panels and said bracket means together into an assembled container, each panel having two parallel ends and two parallel longer sides with a rectangular facing and having a marginal reinforcing backing frame, passing said components through at least one such effectively available access hole to the interior of said structure, assembling said container from said components within said structure with an open top from at least one bottom panel and from at least two respective side panels and at least one end panel which serve to frame at right angles the outer edges of the bottom panel, said bracket means being in the form of angle irons each for a respective right angle joint between pairs of said panels with one leg of each angle iron securable to one panel of its respective pair of panels and the other leg of such angle iron securable to the other panel of its respective pair of panels, said container being assembled using said quick connect-disconect means in the form of slotted wedge bolts, at each right angle joint between adjacent pairs of panels the edge of at least one of said panels and at least one leg of the angle iron at such right angle joint have corresponding regularly spaced slots sized to accommodate said wedge bolts, each right angle pair of said panels being joined together by at least wedge bolts secured through respectively aligned slots in the angle irons at such joint within the slots in the adjacent edge of one panel of such pair, and using said container within said structure for hoisting said materials.

4. The method according to claim 3, wherein said container is assembled from two bottom panels joined along a respective longer side of each in a common plane, and at each joint between adjacent planer pairs of panels the respective sides of the panels at such joint have correspondingly regularly spaced slots sized to accommodate said wedge bolts, and planar pairs of said panels are joined together by wedge bolts secured through respectively aligned slots.

5. The method according to claim 4, wherein said panels are all the same width, said container is assembled closed only at one end, said bracket means further comprises an angle iron fixed by wedge bolts at the open end of said container to the ends of said floor panels to brace the latter in their planer relationship and also a pair of walers spaced from each other with each secured to extend across the bottom of both floor panels to similarly brace the latter, and substantially all of said container components have other useds for concrete forming.

6. The method according to claim 5, wherein column lift brackets are used at the respective two corner joints between the single end panel and the respective side panels, and two gang lift brackets are each connected to the upper portion of a respective side panel remote from its respective column lift bracket.

7. The method according to claim 4, wherein said container is assembled from one bottom panel and two respective side panels fixed at right angles thereto to form a U-shaped container open at both ends with a bracket across the upper portion of one end of said container.

8. The method according to claim 4, wherein the other leg of each angle iron in a pair of right angle panels is joined to the other panel of such pair by wedge bolts.

9. The method according to claim 3, wherein the other leg of each angle iron in a pair of right angle panels is welded to the other panel of such pair.

10. A box-like container adapted for quick assembly and disassembly, comprising a container having at least a floor and two sides, said container having several component parts all sized to pass through an opening of predetermined size which is too small to pass the container in its assembled form, said parts including a plurality of panels constitituting the floor and sides of said container, bracket means for joining pairs of said panels at right angles, and quick connect-disconnect means in the form of wedge bolts and co-operative slots in appropriate component parts for securing said panels and said bracket means together in the assembled container, each panel having a rectangular facing with a marginal reinforcing backing frame, and a stiffening means secured across at least one end of said container for bracing the sides relative to the floor of said container.

11. The container according to claim 10, wherein said container has one bottom panel and two respective side panels fixed at right angles thereto to form a U-shaped container open at both ends with said stiffening means in the form of a bracket being positioned across the upper portion of one end of said container and extending from about the upper corner of one side to about the upper corner of the other side at that end.

12. The container according to claim 10, wherein the width of the widest component part is no more than about two and one-half feet.

13. A box-like lift container adapted for quick assembly and disassembly, comprising an open-topped container having at least a floor and two sides, said container having several component parts all sized to pass through an opening of predetermined size which is too small to pass the container in its assembled form, said parts including a pluraity of concrete forming panels constituting the floor and sides of said container, bracket means for joining pairs of said panels at right angles, and quick connect-disconnect means for securing said panels and said bracket means together in the assembled container, each panel having a rectangular facing with two parallel ends and two parallel longer sides and with a marginal reinforcing backing frame, and a stiffening means in the form of an end panel secured across and closing off at least one end of said container for bracing the sides relatives to the floor of said container, said floor having two bottom panels joined in a common plane along the respective longer side of each which together with at least two respective side panels and at least one end panel serve to frame at right angles at least three of the outer edges of the combined bottom floor panels, said bracket means being in the form of angle irons each placed at a respective right angle joint between pairs of said panels with one leg of each angle iron secured to one of its respective pair of panels and the other leg of such angle iron secured to the other panel of such respective pair of panels, the quick connect-disconnect means are slotted wedge bolts, the rectangular facing of said panels and the angle irons have correspondingly regularly spaced slots sized to accommodate said wedge bolts, and planar pairs of said panels and right angle pairs of said panels with angle irons are joined together by wedge bolts secured through respectively aligned slots.

14. The container according to claim 13, wherein said panels are all the same width, said container is assembled closed only at one end, said bracket means further comprises an angle iron fixed by wedge bolts at the open end of said container to the ends of said two floor panels to brace the latter in their planar relationship and also a pair of walers spaced from each other with each secured to extend across the bottom of both floor panels similarly to brace the latter.

15. The container according to claim 14, wherein substantially all of said container component parts are each are usable in concrete forming equipment other than said lift container.

16. The container according to claim 15, wherein the angle irons used at the respective two corner joints between the single end panel and the respective side panels are column lift brackets, each of the two sides are the same as each other and are comprised of two panels of different length joined end-to-end with the longer of each being joined to the respective column lift bracket, and said component parts further including two gang lift brackets, each connected to the upper portion of a respective side at the end-to-end joint of said side panels remote from said lift column brackets.

* * * * *

UNITED STATES PATENT AND TRADEMARK OFFICE

CERTIFICATE OF CORRECTION

PATENT NO. : 4,733,896

DATED : March 29, 1988

INVENTOR(S) : Richard A. Klein

It is certified that error appears in the above-identified patent and that said Letters Patent is hereby corrected as shown below:

IN THE CLAIMS:

Claim 1, line 1 (patent column 6, line 61), "poprtable" should read --portable--;

claim 1, line 12 (patent column 7, line 4), "joing" should read --joining;

claim 5, line 10 (patent column 8, line 4), "useds" should read --uses--; and claim 10, line 1 (patent column 8, line 25), after "box-like" insert --lift--.

Signed and Sealed this

Eleventh Day of October, 1988

*Attest:*

DONALD J. QUIGG

*Attesting Officer*

*Commissioner of Patents and Trademarks*